US009850091B2

(12) United States Patent
Pollet et al.

(10) Patent No.: US 9,850,091 B2
(45) Date of Patent: Dec. 26, 2017

(54) CONICAL WINDING OF ELONGATED MATERIAL

(71) Applicant: NV BEKAERT SA, Zwevegem (BE)

(72) Inventors: Lieven Pollet, Meulebeke (BE); Paul Harinck, Harelbeke (BE)

(73) Assignee: NV BEKAERT SA, Zwevegem (BE)

( * ) Notice: Subject to any disclaimer, the term of this patent is extended or adjusted under 35 U.S.C. 154(b) by 0 days.

(21) Appl. No.: 15/126,223

(22) PCT Filed: Feb. 19, 2015

(86) PCT No.: PCT/EP2015/053461
§ 371 (c)(1),
(2) Date: Sep. 14, 2016

(87) PCT Pub. No.: WO2015/161941
PCT Pub. Date: Oct. 29, 2015

(65) Prior Publication Data

US 2017/0081143 A1 Mar. 23, 2017

(30) Foreign Application Priority Data

Apr. 25, 2014 (EP) ..... 14166043

(51) Int. Cl.
*B65H 54/10* (2006.01)
*B65H 54/12* (2006.01)
*B65H 55/04* (2006.01)

(52) U.S. Cl.
CPC ..... *B65H 54/103* (2013.01); *B65H 54/12* (2013.01); *B65H 55/04* (2013.01); *B65H 2701/36* (2013.01)

(58) Field of Classification Search
CPC ..... B65H 54/103; B65H 54/12; B65H 55/04; B65H 2701/36
See application file for complete search history.

(56) References Cited

U.S. PATENT DOCUMENTS

| | | | |
|---|---|---|---|
| 4,253,298 A | 3/1981 | Varga | |
| 5,028,013 A | 7/1991 | Anseel | |
| 5,255,863 A | 10/1993 | Horndler | |

FOREIGN PATENT DOCUMENTS

| | | | |
|---|---|---|---|
| BE | 1000634 A3 * | 2/1989 | ..... B65H 55/04 |
| DE | 3811284 A1 * | 10/1989 | ..... B65H 55/04 |
| EP | 0241964 A1 | 10/1987 | |

OTHER PUBLICATIONS

International Search Report (ISR) dated May 12, 2015, for PCT/EP2015/053461.

* cited by examiner

*Primary Examiner* — William E Dondero
(74) *Attorney, Agent, or Firm* — Bacon & Thomas, PLLC

(57) ABSTRACT

An arrangement of elongated material wound in a plurality of layers on a spool having a cylindrical core, a bottom flange and a top flange. A first series of layer form a conical basis of elongated material on the core where elongated material is present at the bottom flange in a larger amount than at the top flange. A second series of layers is wound over the conical basis. The conical basis is formed by a first layer being wound on the cylindrical core between the bottom flange and the top flange in a first number of windings, a second layer being wound on the first layer in a second number of windings being equal to or smaller than the first number of windings, the second layer reaching the bottom flange, where additional layers are wound on the second layer in numbers of windings.

11 Claims, 2 Drawing Sheets

CONICAL WINDING OF ELONGATED MATERIAL

The invention relates to an arrangement of elongated material wound in a plurality of layers on a spool. The invention also relates to a method of winding a plurality of layers on a spool. The invention particularly relates to conical arrangement of the elongated material on the spool.

BACKGROUND ART

The prior art reflects quite some examples of conical arrangement of elongated material on a spool.

For example, EP-A1-0 241 964 discloses a way of conical winding metal wire on a spool with a cylindrical core and with at least one conical flange. The winding layers are conically arranged with respect to the cylindrical core. The conical winding layers have the advantage of forming a stable structure with a strongly reduced danger that the windings will slide down the core of the spool, when the spool is positioned vertically.

DE-A1-38 11 284 discloses another way of conical winding wire material. Conical layers are built on a spool with a cylindrical core and with two planar flanges. This embodiment also has the advantage of providing a stable coil.

BE-A3-1 000 634 discloses an improvement whereby the conical coil of wire made by conical layers receives additional conical layers of wire with a reducing number of windings so that the external final form becomes a cylindrical jacket. This embodiment has the advantage of adding weight to the same spool.

A further evolution is disclosed in U.S. Pat. No. 5,255,863. Here strand-like material is wound in conical layers on a conical core of a spool with planar flanges. The angle of the conical core is opposite to the angle of the conical layers. The advantage of this counter-conical winding on a conical core is that after winding, one may take away the flanges and the core, since a stable coreless coil has been left over.

Spools are only temporary storage of the elongated material. Sooner or later, the elongated material has to be unwound from the spool for further or final use. Despite the fact that the prior art embodiments all have the advantage of providing a stable coil, the prior art embodiments have the drawback that unwinding, and particularly stationary unwinding, may cause problems which often lead to fracture of the elongated material. It is hereby understood that the terms 'stationary unwinding' refer to a method of unwinding where the spool is not rotated but stands still.

SUMMARY OF THE INVENTION

The primary object of the invention is to avoid the problems of the prior art.

Another object of the invention is to avoid or at least to mitigate the problems during unwinding.

Yet another object of the invention is to keep the advantage of having a stable wound coil of elongated material.

Still another object of the invention is to provide an alternative way of conical winding.

According a first aspect of the invention, there is provided an arrangement of elongated material wound in a plurality of layers on a spool. The spool comprises a cylindrical core, a bottom flange and a top flange. A first series of layers is forming a conical basis of elongated material on the core so that elongated material is present at the bottom flange in a larger amount than at the top flange. A second series of layers is wound over the conical basis and extends from bottom flange to top flange thereby keeping a conical form of the wound elongated material. The improvement lies in the fact that the conical basis is formed by:

- a first layer being wound between the bottom flange and the top flange in a first number of windings,
- a second layer being wound on the first layer in a second number of windings, whereby the second number of windings is equal to or smaller than the first number of windings, the second layer reaches the bottom flange but not necessarily the top flange,
- additional layers being wound on the second layer in numbers of windings where these numbers of windings decrease on average as the conical basis is being formed, the additional layers reach the bottom flange but not the top flange.

The term 'spool' refers to a spool, a bobbin or a reel.

The term 'winding' refers to a 360° revolution of the elongated material around the core of the spool.

The term 'layer' refers to a subsequent number of windings in one direction with a determined winding pitch. The winding pitch is the distance between two subsequent windings measured in the direction of the axis of the core. The winding pitch is greater than or equal to the diameter of the elongated material, and is preferably greater than the diameter of the elongated material so that layers are created which are unsaturated, i.e. where the neighbouring windings do not touch each other.

The terms 'reach the bottom flange' or 'from the bottom flange' do not necessarily mean that the elongated material comes in physical contact with the bottom flange or the top flange. It means that the distance between the elongated material and the bottom flange is less than one winding pitch. The same is valid—mutatis mutandis—for the top flange. The terms 'these numbers of windings decrease on average' means that a layer has a number of windings which is equal to or less than the number of windings of the previous layer.

In a preferable embodiment, the top flange of the spool is conical, which facilitates the unwinding process, and particularly stationary unwinding.

The bottom flange may also be conical.

The elongated material may be a metal wire or a metal cord, preferably with a round or almost round cross-section.

The present invention reduces or avoids unwinding problems and, as such, is particularly suited for elongated material with a moderate tensile strength, i.e. a tensile strength below 1000 MPa, e.g. below 800 MPa, e.g. below 600 MPa.

An example of an elongated material with a low tensile strength is an annealed low-carbon steel wire.

A low carbon steel wire is a steel wire with a plain carbon steel composition along following lines: The carbon content ranges up to 0.20 percent by weight, e.g. up to 0.10 percent by weight, e.g. ranging up to 0.06 percent by weight. The minimum carbon content can be about 0.02 percent by weight. Possibly with exception for silicon and manganese, all the elements have a content of less than 0.50 percent by weight, e.g. less than 0.20 percent by weight, e.g. less than 0.10 percent by weight. Silicon is present in amounts of maximum 1.0 percent by weight, e.g. maximum 0.50 percent by weight, e.g. 0.30 wt % or 0.15 wt %.

Manganese is present in amount of maximum 2.0 percent by weight, e.g. maximum 1.0 percent by weight, e.g. 0.50 wt % or 0.30 wt %.

An annealed low carbon wire is a low carbon wire which has undergone a heat treatment in the range of 550° C. to 670° C. in order to recrystallize the ferrite grains and to make the wire deformable. Its tensile strength after annealing may be lower than 500 MPa, and may lie in the range between 300 MPa and 400 MPa.

Examples of other elongated material with a low tensile strength are copper wires, aluminium wires, bronze wires, brass wires, copper cables, aluminium cables.

The diameter of the elongated material to be wound preferably ranges from 0.15 mm to 2.20 mm, e.g. from 0.20 mm to 1.20 mm.

The conical basis formed on the core of the spool preferably forms an angle $\alpha$ with the cylindrical core, which angle $\alpha$ ranges from 1° to 15°, e.g. from 1° to 5°. Preferably this angle $\alpha$ is kept below 5° to 10° in order to have as much as possible elongated material on the spool. The minimum angle must be greater than 1° in order to keep the advantage of conical winding.

In case the top flange or the bottom flange or both are conical, these flanges preferably form an angle $\beta$ with a plane that is perpendicular to the core of the spool. This angle $\beta$ preferably ranges from 10° to 40°, e.g. from 15° to 35°.

According to a second aspect of the invention, there is provided a method of winding a plurality of layers of an elongated material on a spool. The method of winding comprises the following steps:

a) providing a spool with a cylindrical core, a bottom flange and a top flange;

b) forming a conical basis on the cylindrical core with a first series of layers by:

winding a first layer between the bottom flange and the top flange in a first number of windings;

winding a second layer from the bottom flange in a second number of windings, this second number of windings is equal to or smaller than the first number of windings, the second layer reaches the bottom flange but not necessarily the top flange;

winding additional layers on the second layer in numbers of windings, where these numbers of windings decrease on average as the conical basis is being formed, the additional layers reaching the bottom flange but not the top flange.

A second series of layers may be wound over the conical basis and may extend between the bottom flange and the top flange thereby keeping a conical form of the wound elongated material.

DETAILED DESCRIPTION OF THE INVENTION

Figure 1:
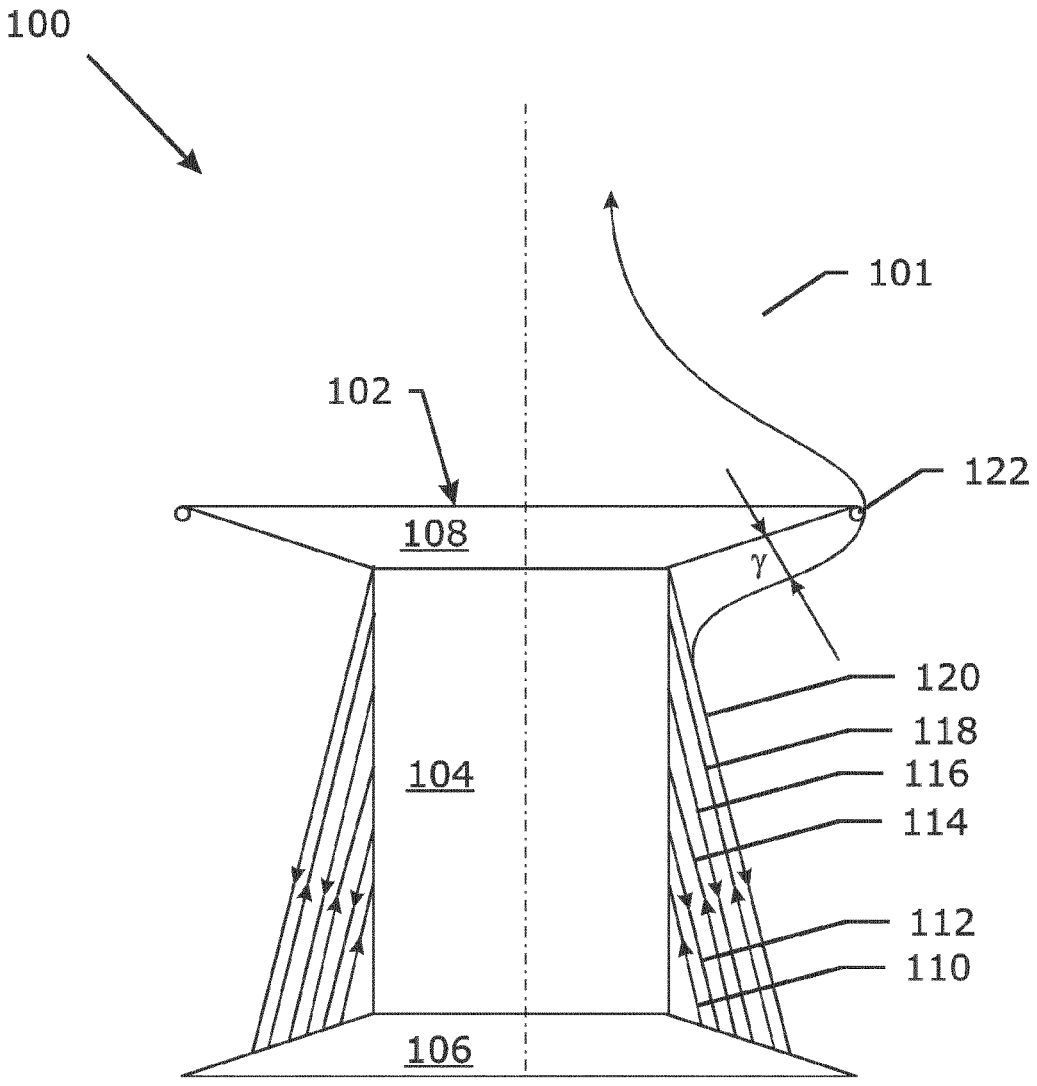
PRIOR ART Fig. 1
FIG. 1 gives a schematic view of the prior art of conical winding.

FIG. 1 shows a prior art embodiment 100 of metal wire 101 conically wound on a spool 102. The spool 102 has a cylindrical core 104, a conical bottom flange 106 and a conical top flange 108. The windings of wire 101 are forming conical layers, starting with a short mounting layer 110, followed by a somewhat longer descending layer 112, a mounting layer 114 greater in length than the previous layer 112, a descending layer 116 again great in length than the previous layer 114, a mounting layer 118 greater in length than the previous layer 116, a descending layer 120 greater in length than the previous layer 118, and so on until a conical basis is formed.

This way of conical winding with conical layers 110-120 may lead to unwinding problems, particularly in case of stationary unwinding. Stationary unwinding is a way of unwinding whereby the spool stands still, i.e. the spool is not rotating. The wire 101 is unwound over the top flange 108, e.g. over a ring 122 or over a pay-off installation as disclosed in U.S. Pat. No. 5,028,013. During the unwinding operation, the wire 101 receives a twist per rotation or per winding. The unwinding problems are likely to occur when at the same time the wire 101 to be unwound is close to the core 104 and the angle $\gamma$ between the wire 101 and the top flange 108 is small. The smaller the angle $\gamma$, the greater the tension in the wire 101. More precisely, problems occur not when the wire 101 is very close to the top flange 108, but when the wire 101 is at a distance of 3 to 8 cm from the top flange 108.

Due to a combined effect of the greater tension in the wire 101, the twist given to the wire 101 and the swinging effect of the wire 101, previous windings may jump up and over following windings leading to windings being clamped. When it comes up to these windings to be unwound, the tension in the wire 101 increases leading to vibrations of the spool 102 and even to fractures of the wire 101.

As shown on FIG. 1, the risk for fractures occurs at a moment where the complete conical basis still is to be unwound, i.e. at a moment when there is still a substantial amount of wire 101 on the spool 102.

Figure 2A:
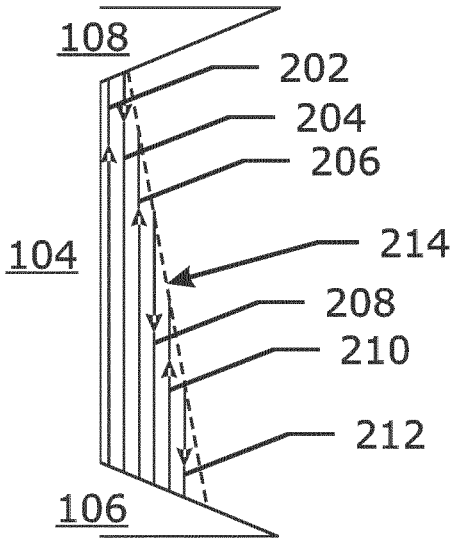
FIG. 2*a* illustrates how the conical basis the conical winding according to the invention is built and FIG. 2*b* illustrates how the process of winding is carried out after building the conical basis.

FIG. 2*a* shows a right side of a spool 102 and building up of layers according to the invention.

A first pair of layers 202, 204 extends between the bottom flange 106 and the top flange 108: a mounting layer 202 and a descending layer 204. The second pair of layers 206, 208 starts from the bottom flange 106, but does not reach until the top flange 108. This second pair of layers 206, 208 has less number of windings than the first pair of layers 202, 204. The third pair of layers 210, 212 also starts from the bottom flange 106 and has less number of windings than the second pair of layers 206, 208. This goes on until a conical basis 214 has been formed.

Figure 2B:
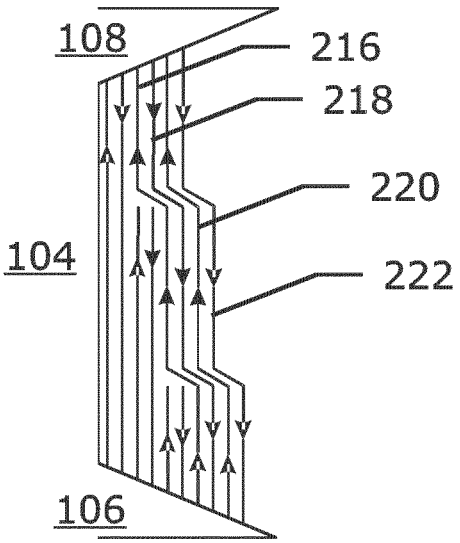

FIG. 2*b* illustrates the continuation of the winding process. After formation of the conical basis, the followings layers 216, 218, 220 and 222 all extend between the bottom flange 106 and the top flange 108.

Figure 3:
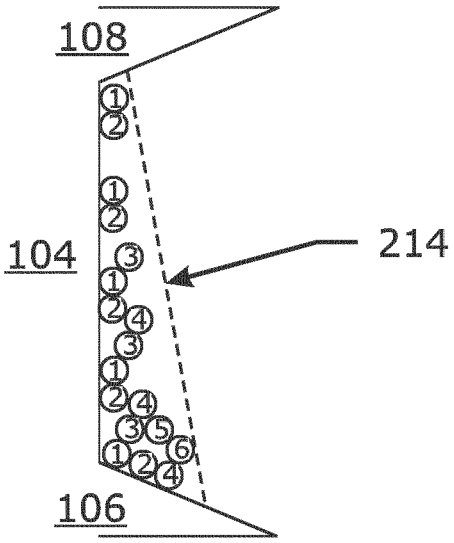
FIG. 3 illustrates in more detail the building of the conical basis according to the invention.

FIG. 3 illustrates winding per winding the way of building up the conical basis 214. The circles with a cipher 1 inside refer to windings of the first mounting layer 202, the circles with a cipher 2 inside refer to windings of the second descending layer 204, the circles with a cipher 3 inside refer to windings of the third mounting layer 206, the circles with a cipher 4 inside refer to windings of the fourth descending layer 208, the circles with a cipher 5 inside refer to the windings of the fifth mounting layer 210 and the circles with a cipher 6 inside refer to windings of the sixth descending layer 212.

The advantage of the invention is explained as follows. As mentioned, problems with unwinding are likely to occur when at the same time the wire to be unwound is close to the core 104 and the angle $\gamma$ is small. Referring to FIG. 2*a* as well as to FIG. 3, this occurs in the first pairs of layers, e.g. 202, 204. This means that problems such as vibrations or fracture of the wire may occur at a moment in time when the spool is almost empty. This is in big contrast with the prior art where the problems are likely to occur at the beginning of the unwinding of the complete conical basis.

FIGS. 1, 2*a*, 2*b* and 3 are only for illustrations. In practice the number of layers needed to make the conical basis may be larger. It all depends upon the geometry of the spool, more particularly the height of the spool, the winding pitch, and the angle α formed by the conical basis with the core of the spool and the diameter of the elongated material.

The height of the spool may range from 100 mm to 500 mm and more, e.g. from 200 mm to 450 mm.

Winding tensions vary and depend upon the breaking load of the elongated material. Low carbon steel wires of 0.25 mm may be wound with a winding tension of 2 Newton, low carbon steel wires of 0.65 mm may be wound with a winding tension of 10 Newton.

The winding pitch may range from 1 mm to 5 mm, e.g. from 2 mm to 4 mm. Anyway, the winding pitch is greater than the diameter of the elongated element.

In order to have an angle α of 2° with a spool height of 300 mm, the number of layers needed to make this conical basis mainly depends upon the diameter of the elongated material and may vary between 5 layers (big diameter of more than 0.65 mm) and more than 100 layers (small diameter less than 0.23 mm).

LIST OF REFERENCE NUMBERS

100 arrangement of spool and wire
101 wire
102 spool
104 core
106 bottom flange
108 top flange
110 first mounting layer
112 second descending layer
114 third mounting layer
116 fourth descending layer
118 fifth mounting layer
120 sixth descending layer
122 guiding ring
202 first mounting layer
204 second descending layer
206 third mounting layer
208 fourth descending layer
210 fifth mounting layer
212 sixth descending layer
214 conical basis
216-218-220-222 layers upon conical basis

The invention claimed is:

1. An arrangement of elongated material wound in a plurality of layers on a spool, said spool comprising a cylindrical core, a bottom flange and a top flange, a first series of layers forming a conical basis of elongated material on the core so that elongated material is present at the bottom flange in a larger amount than at the top flange, a second series of layers being wound over the conical basis and extending from the bottom flange to the top flange thereby keeping a conical form of the wound elongated material, wherein the conical basis is formed by:

a first layer being wound on the cylindrical core between the bottom flange and the top flange in a first number of windings, a second layer being wound on the first layer in a second number of windings, said second number of windings being equal to or smaller than the first number of windings, said second layer reaching the bottom flange but not necessarily the top flange, additional layers being wound on the second layer in numbers of windings where these numbers of windings decrease on average as the conical basis is being formed, said additional layers reaching the bottom flange.

2. The arrangement according to claim 1, wherein the top flange is conical.

3. The arrangement according to claim 2, wherein the bottom flange is conical.

4. The arrangement according to claim 3, wherein said bottom flange and said top flange form an angle β with a plane that is perpendicular to the cylindrical core, said angle β ranging from 10° to 40°.

5. The arrangement according to claim 1, wherein the elongated material is a metal wire or a metal cord.

6. The arrangement according to claim 1, wherein the elongated material has a tensile strength less than 1000 MPa.

7. The arrangement according to claim 6, wherein the elongated material is an annealed low-carbon steel wire.

8. The arrangement according to claim 1, wherein said elongated material has a diameter ranging from 0.15 mm to 2.20 mm.

9. The arrangement according to claim 1, wherein said conical basis forms an angle α with the cylindrical core, said angle α ranging from 1° to 15°.

10. A method of winding a plurality of layers of an elongated material on a spool, said method comprising the following steps:

providing a spool with a cylindrical core, a bottom flange and a top flange;

forming a conical basis on the cylindrical core with a first series of layers by:

winding a first layer between the bottom flange and the top flange in a first number of windings;

winding a second layer in a second number of windings, said second number of windings being equal to or smaller than the first number of windings, said second layer reaching the bottom flange but not necessarily the top flange;

winding additional layers on the second layer in numbers of windings, where these numbers of windings decrease on average as the conical basis is being formed, said additional layers reaching the bottom flange.

11. The method according to claim 10, the method further comprising the step of:

winding a second series of layers over the conical basis and extending between from the bottom flange to the top flange thereby keeping a conical form of the wound elongated material.

* * * * *